US005155945A

United States Patent [19]

Tyler et al.

[11] Patent Number: 5,155,945

[45] Date of Patent: Oct. 20, 1992

[54] ABRASIVE FINISHING ELEMENTS, TOOLS MADE FROM SUCH ELEMENTS, AND METHODS OF MAKING SUCH TOOLS

[75] Inventors: James B. Tyler, Westlake; Alfred F. Scheider, Orange; R. Brown Warner, Westlake, all of Ohio

[73] Assignee: Jason, Inc., Cleveland, Ohio

[21] Appl. No.: 471,385

[22] Filed: Jan. 29, 1990

[51] Int. Cl.[5] ..... B23F 19/05

[52] U.S. Cl. ..... 51/330; 51/331

[58] Field of Search ..... 51/331, 330, 358, 360, 51/391, 392, 394, 397, 395, 403; 15/180, 159, 162, 164, 207

[56] References Cited

U.S. PATENT DOCUMENTS

| | | | |
|---|---|---|---|
| 2,049,324 | 7/1936 | Schneider | 51/179.6 |
| 2,214,515 | 9/1940 | Vanderveer | 51/391 |
| 2,421,647 | 6/1947 | Peterson | 15/180 |
| 3,312,993 | 4/1967 | Nelson | 15/180 |
| 4,154,026 | 5/1979 | Dalthe | 51/403 |
| 4,285,171 | 8/1981 | Block et al. | 51/337 |
| 4,305,234 | 12/1981 | Pichelman | 51/330 |
| 4,364,746 | 12/1982 | Bitzer et al. | 51/307 |
| 4,625,466 | 12/1986 | Sargusa | 51/403 |
| 4,668,248 | 5/1987 | Deffelbach et al. | 51/206 P |

*Primary Examiner*—M. Rachuba

*Attorney, Agent, or Firm*—Renner, Otto, Boisselle & Sklar

[57] ABSTRACT

A plastic strip or strap having granular abrasive embedded homogeneously throughout is cut, shaped and formed into a variety of abrasive finishing tools. The plastic working element is preferably rather stiff 6/12 nylon and contains about 30 to 45% by weight of abrasive material. The strip or strap is formed by extrusion of such non-elastomeric plastic through a ceramic die opening and as extruded has an indefinite length in the machine direction, a controlled uniform thickness, and a width which is approximately 5 to 50 times or more the thickness. A preferred width to thickness ratio is about 30:1, or about 1 mm to 3 cm. The strip or strap may be cut to the desired length and partially embossed, serrated or scored either lengthwise or transversely to provide fracture or flex lines. The spacing of the serrations or score lines controls the degree of flexibility or aggressiveness of the tool working face. The use of a fairly wide strip with serrations or scores not only provides an improved tool but greatly facilitates the construction of the tool. The invention includes a variety of tools formed from the abrasive strip or strap and these include radial or flap wheels, both serrated and non-serrated, internal tools using a rotatable stem, also both serrated and non-serrated. Such tools may employ the strips or straps straight, or bent to an S-shape or formed so that the edge of the strip or straps is in the form of a helix. Such strips may be secured to the stem at a notch to provide both a side and bottom working edge for internal wall work. Also the edges of the strip may be chamfered. A spot facing tool may be formed by tightly coiling a length of strip or strap and then driving the coiled strip into liquid adhesive at the bottom of a holder. The strips or straps may be folded around wires or cores and clinched with a channel to form a strip which may then be assembled to form disc or cylindrical strip tools. In such construction the strip or strap may be scored or serrated transversely of its length.

39 Claims, 4 Drawing Sheets

ABRASIVE FINISHING ELEMENTS, TOOLS MADE FROM SUCH ELEMENTS, AND METHODS OF MAKING SUCH TOOLS

This invention relates generally as indicated to abrasive finishing elements, tools made from such elements, and methods of making such tools.

BACKGROUND OF THE INVENTION

Abrasive tools utilizing rectangular in section nylon monofilaments with abrasive grains embedded homogeneously therein throughout, have been employed to make abrasive finishing tools. Examples of such tools may be seen in the prior applications for U.S. Letters Patent of Alfred F. Scheider et al, Ser. Nos. 216,710 and 409,680 entitled "Rotary Abrasive Tool And Filament Therefor" and "Abrasive Finishing Tool", respectively, filed Jul. 8, 1988 and Sep. 20, 1989, respectively, and the prior applications of R. Brown Warner et al entitled "Flexible Abrasive Grinding Tool", filed Jul. 8, 1988, and "Adhesive Bonded Flexible Abrasive Finishing Tool", Ser. No. 228,438, filed Aug. 5, 1988.

Such tools have proven to be very effective in the abrasive finishing of a wide variety of workpieces such as those made of exotic alloys and composites. For some workpieces an even more aggressive tool is desirable. Also the manufacture of such tools from discrete monofilaments is difficult and expensive.

As illustrated in prior applications Ser. Nos. 216,709 and 409,680 bundles or tufts of such discrete monofilaments may be heated and formed in S-shape configurations to present a flat side of the monofilament to the work. Such bundles are difficult to handle and form, particularly if a precise tool size and form is desired.

One of the more common abrasive finishing wheels employed is a flap wheel. Typically such flap wheels are formed by a radial array of sheets of paper or rayon cloth with a layer of abrasive grit such as aluminum oxide resin bonded to one side thereof. Such tools are useful for contoured polishing, cutting and blending of ferrous and non-ferrous metals, plastic and wood. However, such tools can only be run in one direction. The layer of abrasive adhered to one side of the cloth tends to wear the cloth or paper of the adjacent flap. Also during operation buildup may occur between the flaps in part because of lack of abrasive on one side of the flap and that the tool runs in only one direction. Also, such tools are usually not sufficiently aggressive for some applications, particularly where exotic alloys or composites are the workpieces. If a tool could be formed of an array of plastic straps or tapes with abrasive embedded therein homogeneously throughout, the tool could run in opposite directions, be self-cleaning, and be sufficiently aggressive for work on exotic alloys and composites.

SUMMARY OF THE INVENTION

A plastic strip or strap working element having granular abrasive embedded homogeneously throughout is cut, assembled, shaped and formed into a variety of abrasive finishing tools. The plastic is preferably rather stiff 6/12 nylon and contains up to about 30 to 45% by weight of abrasive material. The strip or strap is formed by extrusion of a non-elastomeric plastic through a ceramic die opening and as extruded has an indefinite length in the machine direction, a controlled uniform thickness, and a width which is approximately 5 to 50 times or more the thickness. A preferred width to thickness ratio is about 30:1, or about 1 mm to 3 cm.

The strip or strap may be cut to the desired length and partially embossed, serrated or scored either lengthwise or transversely to provide fracture or flex lines. The spacing of the serrations or score lines controls the degree of flexibility or aggressiveness of the tool working face. The use of a fairly wide strip with serrations or scores not only provides an improved tool but greatly facilitates the construction of the tool.

The invention includes a variety of tools formed from the abrasive strap or tape and these include radial or flap wheels, both serrated and non-serrated, and internal tools using a rotatable stem, also both serrated and non-serrated. Such tools may employ the strips or straps straight, or bent to an S-shape, or formed so that the edge of the strip or strips is in the form of a helix. Such strips may be secured to the stem at a notch to provide both a side and bottom working edge for internal wall work. Also the edges of the strip may be chamfered. A spot facing tool may be formed by tightly coiling a length of strip or strap and then driving the coiled strip into liquid adhesive at the bottom of a holder. The strips or tapes may be folded around wires or cores and clinched with a channel to form a strip which may then be assembled to form disc or cylindrical strip tools. In such construction the strip or strap may be scored or serrated transversely of its length.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
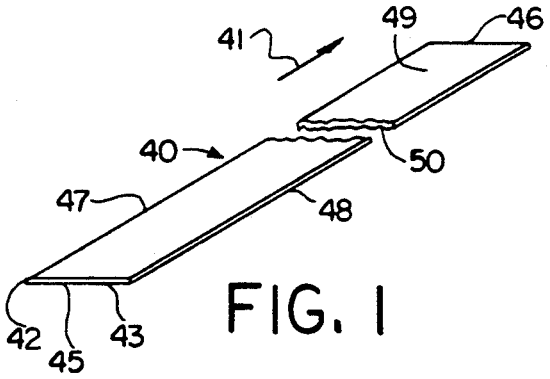
FIG. 1 is a broken perspective of strap, band or strip plastic element which has abrasive grains homogeneously embedded therein throughout.

Referring first to FIG. 1 there is illustrated a plastic strip or strap working element in accordance with the present invention. The strip or strap is formed by extrusion of a non-elastomeric plastic melt extrudate through a ceramic die opening and as extruded has an indefinite length in the machine direction shown by the arrow 41, a controlled uniform thickness 42 and a width 43 which is approximately 5 to 50 times or more the thickness. The strip or strap plastic melt material has a granular abrasive embedded therein homogeneously throughout and such abrasive may preferably be up to about 30 to about 45% by weight of the strip or strap. The strip or strap may be cut to length and as such is provided with ends 45 and 46. The strap of course also has transverse or lateral edges 47 and 48. The strip or strap also has parallel flat faces 49 and 50 of major extent.

While the dimensions of the working element may vary widely, the thickness of the working element may vary in the English system measurement from about 0.020 inch to approximately 0.050 inch or preferably about 0.030 inch. The width may vary from approximately one inch to approximately 6 inches. In the metric system the thickness may be approximately 1 mm and the width at its higher range may be slightly more than 15 cm. Preferably the width of the working element is 5 times the thickness but as indicated may be 50 or more times the thickness. A preferred width to thickness ratio is about 30:1, or 3 cm to 1 mm, for example.

As indicated, the preferred plastic for extrusion of the strip or strap working element is nylon. The preferred nylon is 6/12 nylon.

Nylons are long-chain partially crystalline synthetic polymeric amides (polyamides). Polyamides are formed primarily by condensation reactions of diamines and dibasic acids or a material having both the acid and amine functionality.

Nylons have excellent resistance to oils and greases, in solvents and bases. Nylons have superior performance against repeated impact, abrasion, and fatigue. Other physical properties include a low coefficient of friction, high tensile strength, and toughness. Useful mechanical properties of nylon include strength, stiffness and toughness. In general, the greater the amount of amide linkages, the greater the stiffness, the higher the tensile strength, and the higher the melting point. Several useful forms of nylon are available and include:

A. Nylon 6/6 synthesized from hexamethylenediamine (HMD) and adipic acid;
B. Nylong 6/9 synthesized from HMD and azelaic acid;
C. Nylon 6/10 synthesized from HMD and sebacic acid;
D. Nylon 6/12 synthesized from HMD and dodecanedioic acid;
E. Nylon 6 synthesized from polycaprolactam;
F. Nylon 11 synthesized from 11-aminoundecanoic acid;
G. Nylon 12 synthesized from polyaurolactam; and others.

Nylons useful in the present invention have a Young's modulus greater than 0.05, preferably greater than 0.1 and preferably greater than 0.2. Young's modulus is defined as the amount of force a material can undergo without permanent deformation when the force is removed. This is a measure of elasticity or the relationship of stress over strain.

The preferred nylon is nylon 6/12. The physical properties of nylon 6/12 include a melting point of 212° C., a dry yield strength at $10^3$ psi of 8.8 (7.4 at 50% RH), a dry flexural modulus of 295 (180 at 50% RH). Nylon has a higher Young's modulus (0.40 at $10^6$ psi) than rubber (0.01 at $10^6$ psi), which demonstrates the greater stiffness of nylon over an elastomer such as rubber, for example. As an example, a working element according to the present invention several feet long when held horizontally at one end at room temperature would show little or minimal deflection at the opposite end.

Nylon is partially crystalline, hence has little or no rubbery regions during deformation. The degree of crystallinity determines the stiffness and yield point. As the crystallinity decreases the stiffness and yield stress decreases. Rubber, on the other hand, is an amorphous polymer and its molecular straightening leads to a low modulus of elasticity.

Nylon has a tensile strength of over 8000 psi, rubber has a tensile strength of 300 psi. Nylon exhibits 250% breakage during elongation, rubber exhibits 1200%. Nylon has fair moisture resistance, yet rubber absorbs a large amount of water. Nylon has excellent resistance to oil and greases and other organic solvents, rubber has extremely poor resistance. Nylon retains its properties from −75° F. to 230° F., while rubber has a narrow range around room temperature. Nylon's increased strength, resistance to moisture and solvents, and its wide usable temperature range make it the preferred material for this construction.

Another type of polyamide useful in the present invention include other condensation products with recurring amide groups along the polymer chain, such as aramids. Aramids are defined as a manufactured fiber in which at least 85% of the amide (—C(O)—N(H)—) linkages are attached directly to two aromatic hydrocarbon rings. This is distinguished from nylon which has less than 85% of the amide linkages attached directly to the two aromatic rings.

Aramid fibers are characterized by high tensile strength and high modulus. Two aramides that may be useful in the present invention include fiber formed from the polymerization of p-phenylenediamine with terephthaloyl chloride. The positioning of the groups on the aromatic rings tend to make this aramid a stiffer polymer. A less stiff polymer is formed from a m-phenyldiamine and isophthaloyl chloride. A meta substitution leads to more flexibility.

Aramids demonstrate a very strong resistance to solvents. Aramids have tensile strengths at 250° C. that are exhibited by textile fibers at room temperature.

Also, some thermoset polymers are useful. Polyesters are an example and are long chain synthetic polymers with at least 85% of a dihydric alcohol ester (HOROH) and terephthalic acid (p-$HOOCC_6H_4COOH$). Polyester fibers contain both crystalline and non-crystalline regions. Polyesters are resistant to solvents and demonstrate a breaking elongation of 19 to 40%.

Polyimides are polymers containing (CONHCO) and are also useful in the present invention. High temperature stability (up to 700° F.) and high tensile strength of 13,500 psi make polyimides useful as binders in abrasive wheels.

The abrasive material may vary widely in amount, type and granular or grit size. For example the abrasive material may range from aluminum oxide to the more exotic polycrystalline diamond or cubic boron nitride.

Referring now to FIGS. 2–5 it will be seen that the strap or strip may be partially embossed, serrated or scored either lengthwise or transversely to control or enhance flexibility of the working element or to provide fracture lines of the working elements during use of the tool.

Figure 2:
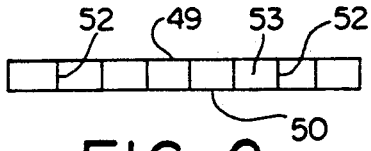
FIG. 2 is an enlarged edge elevation of such an element which is partially slit.

It should be noted that in FIGS. 2–5 there is illustrated either an end view of the working element or a transverse edge view depending upon the type of tool formed. In FIG. 2 the working element is shown slit as seen at 52, such slits extending completely through the working element from one major face 49 to the other major face 50. The slits divide the working element into generally rectangular fingers of uniform width. The slits extend either lengthwise or transversely of the working element preferably to a uniform extent and to an extent necessary to provide the type of tool desired.

It will be appreciated that the rectangular shape of the fingers thus provided may vary by controlling the spacing of the slits.

Figure 3:
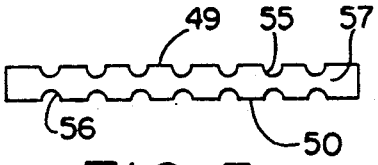
FIG. 3 is a similar edge elevation of the strip with one form of scoring or serrations.

In FIG. 3 there is provided a series of rounded indentations or score lines indicated at 55 and 56 which are parallel to each other and in the opposite faces 49 and 50. The score lines in such opposite faces are aligned perpendicularly to the major faces so that between the score lines as indicated at 57 the working element is reduced to approximately one-third of its normal thickness. Score lines of the type illustrated substantially increase the flexibility of the strap or strip and it will be seen that the closer such score lines are placed to each other the more flexible the strip or strap. Also, if fracture occurs during use of the tool it will occur at the opposed rounded indentation score lines.

Figure 4:
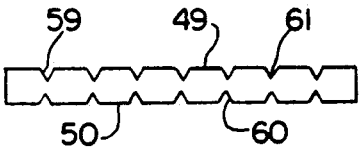
FIG. 4 is a similar edge elevation of the strip with another form of scoring.

Although the rounded indentation scoring of FIG. 3 does not preclude fracture, the scoring shown at 59 and 60 in FIG. 4 is designed to induce fracture of the working element as a result of use of the tool. The score lines of FIG. 4 also of course increase the flexibility of the working element. In FIG. 4 the score lines are in the form of a sharp V and terminate inwardly in a relatively sharp notch 61. With the score lines in opposite faces opposed to each other fracture of the working element during use of the tool will occur at the notch of such score lines.

Figure 5:
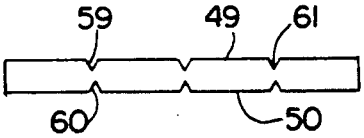
FIG. 5 is a similar view with such scoring of different spacing.

FIG. 5 illustrates scoring having the same configuration as in FIG. 4 but with the parallel scoring more widely spaced thus controlling the width of the generally rectangular finger which is formed when fracture does occur during use of the tool. In any event the strip or strap may be cut to the desired length and partially embossed, serrated or scored either lengthwise or transversely to provide the degree of flexure desired or to provide fracture lines. The spacing of the serrations or score lines controls the degree of flexibility or aggressiveness of the tool working face. Because the working elements are only partially scored or slit, the manufacture of the tools hereinafter described is greatly facilitated.

Figure 6:
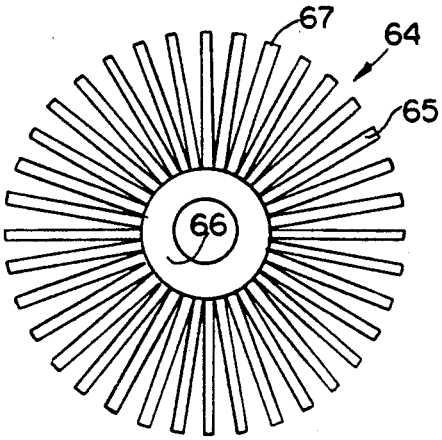
FIG. 6 is an axial elevation of a flap wheel made with a radially extending array of such elements.

Referring now to FIGS. 6–9 and initially to FIG. 6 there is illustrated a rotary wheel 64 which comprises a circular array of working elements 65 in the form of flaps which are secured to hub 66. The working elements may be secured to the hub as the flaps of a sandpaper flap wheel are secured to a rotary hub such as by edge notches intermeshing with the hub parts. The hub is of course designed to be placed on a spindle and rotated about its axis. The working elements are simply cut to uniform length and then radially positioned in the hub and secured in place. The working face of the tool then becomes the cut end 67 of each working element and each working element is the strap or strip of the plastic material such as nylon with the abrasive granular material embedded therein homogeneously throughout. Such tools are useful for contoured polishing, cutting and blending of ferrous and non-ferrous metals, plastic and wood. Because there is abrasive throughout each working element, the abrasive major faces of each working element are juxtaposed and this abrasive nature of the entire surface of the working element prevents build-up between the working element. Also, the tools of FIGS. 6–9 can be rotated in either direction which greatly enhances not only the operation of the tool but also its working life.

It will be appreciated that the working elements of the tool of FIG. 6 may be serrated or slit in the manner shown in FIGS. 2-5. In such tool these serrations or slits will only extend from the outer working edge 67 to a position slightly outwardly of the radial edge 68 of the hub and that portion of the working element within the hub will be unserrated or scored.

Figure 7:
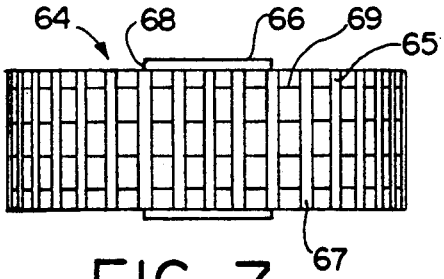
FIG. 7 is a top plan view of such a tool as seen in FIG. 6 with the flaps serrated or scored.
Figure 8:
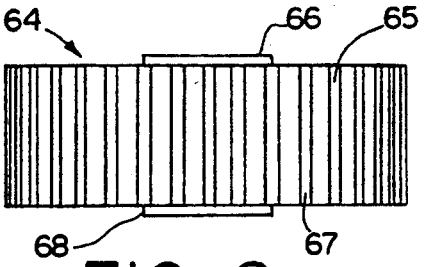
FIG. 8 is a similar view showing such a tool without such serrations or scoring.

FIG. 7 illustrates a tool such as shown in FIG. 6 where the working elements are slit or scored as indicated at 69, such extending from the working end 67 to just outwardly of the edge of the hub 68. FIG. 8 illustrates a tool as shown in FIG. 6 without any scoring or serrations. The tool of FIG. 8 provides a more aggressive abrading action and as indicated the aggressiveness of the tool can be controlled by use of the serrations or slits and their spacing to control the flexibility of the working elements at their working edges.

Figure 9:
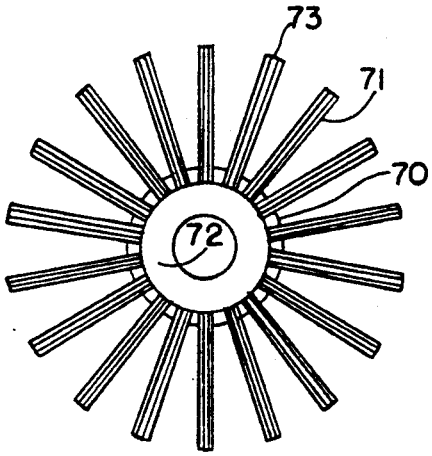
FIG. 9 is a view similar to that of FIG. 6 of a tool utilizing fewer flaps and spacers between flaps or groups of flaps.

FIG. 9 illustrates a radial wheel tool such as shown in FIG. 6 but provided with spacers indicated at 70 positioned between working elements 71. The working elements may be the same as in FIG. 6 and may be individual working elements alternating with the spacers or may be groups of two or more working elements which beyond the spacers are not secured together. While the employment of spacers generally reduces the working element density of the wheel, by grouping the working elements into two or more juxtaposed groups, the stiffness of the group is somewhat enhanced since the working elements in the group tend to support each other as the wheel rotates. Both the spacers and the working elements are secured to the hub 72 and again the working elements may be slit or serrated from their working edges 73 to just outwardly of the spacers 70.

The working element of the present invention is useful in the construction of internal tools for the abrading or honing of the interior surfaces of holes, ports, and the like. Tools useful for abrading or honing the cylindrical sides of holes or ports are seen in FIGS. 11-18 while tools useful for abrading the sides and bottoms of holes are seen in FIGS. 19-23.

Figure 11:
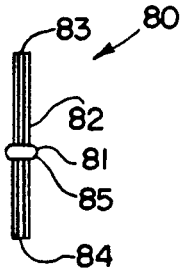
FIG. 11 is an axial end elevation of the tool of FIG. 10 seen from the lefthand side thereof.
Figure 10:
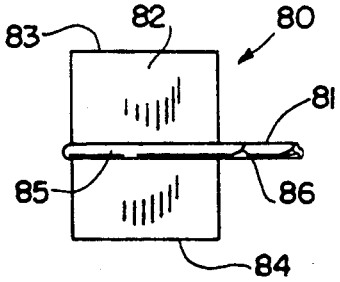
FIG. 10 is a fragmentary side elevation of a twisted stem side action tool with several such strips extending symmetrically of the end of the stem.

Referring initially to FIGS. 10 and 11 there is illustrated an internal tool 80 which comprises a stem 81 and one or more working elements 82 extending transversely of the stem symmetrically at the end thereof. The working elements are simply the strips above described which have been cut to length to form the essentially square tape working elements 82. The illustrated embodiment simply shows three such working elements cut to length to provide working edges 83 and 84. The stem is in the form of a twisted half round wire which is looped around the center of the working elements as indicated at 85 with the parallel wires twisted together beyond the loop as seen at 86 to form a twisted stem which is then mounted in a chuck for rotation of the tool about its axis by means of a suitable power source.

Although the tool of FIG. 10 is not shown slitted or serrated, it will be appreciated that such scoring slits may be provided extending perpendicular to the working edges 83 and 84. In the case of scoring, the entire working element may be scored. If slit, the working element will be slit only to an area adjacent to the loop of the stem so that the stem loop is gripping an unslit portion of the working elements. In operation the tool is inserted into a hole and rotation of the tool causes the working edges 83 and 84 to run against the cylindrical interior of the hole abrading or honing the interior to the desired finish. Slitting or scoring at the working edges enhances the flexibility of the working edge and makes the tool somewhat less aggressive providing enhanced edge blending or cornering at ports or transverse passages.

Figure 12:
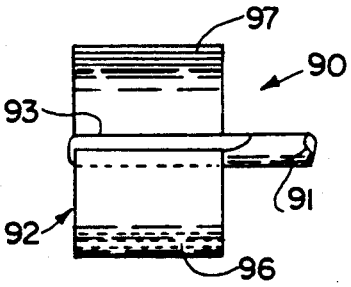
FIG. 12 is a side elevation of a tool similar to that of FIG. 10 but with the strips shaped to present the flat face to the work.
Figure 13:
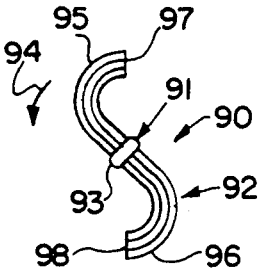
FIG. 13 is an axial elevation of the tool of FIG. 12 as seen from the lefthand side thereof.

Referring now to FIGS. 12 and 13 there is illustrated a tool 90 which is similar to the tool 80 and comprises a twisted half round wire stem 91 looped around the center of working elements 92. As indicated in FIG. 13 there may be more than one working element, such elements being bundled side by side as seen. The working elements 92 are however shaped to the S-shape configuration seen more clearly in FIG. 13. When the tool is rotated in the direction of the arrow 94 the working surfaces of the working elements become the exterior of the end curvatures as seen at 95 and 96 rather than the end edges 97 and 98. The bundle of working elements adds stiffness and rigidity to the working elements with the inner working elements at the curvatures supporting and backing up the outer working elements. Such tool is excellent for honing the cylindrical interior surfaces of a hole, for example.

The tool of FIGS. 12 and 13 can be formed initially as the tool of FIGS. 10 and 11 with the working elements being heated so that the S-shape curvature can be imparted to the working elements. When the proper formation is obtained the working elements are held in that position and cooled to set to the S-shape configuration shown. Reference may be had to copending application Ser. No. 409,680 filed Sep. 20, 1989 for a more detailed disclosure of the manner in which the working elements may be shaped.

Figure 14:
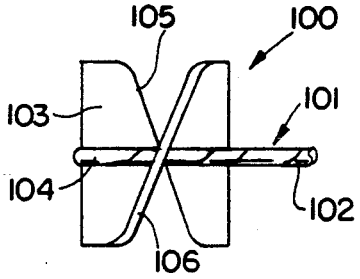
FIG. 14 is a side elevation of a twisted stem tool where the strip or strips are twisted into a helix.
Figure 15:
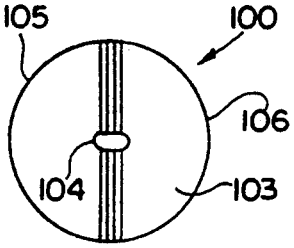
FIG. 15 is an axial end elevation of the tool of FIG. 14 as seen from the lefthand side thereof.

In FIGS. 14 and 15 there is illustrated a helical internal tool 100 wherein the half round wire stem 101 is twisted as indicated at 102 and is looped around the center of the working element or elements 103 as indicated at 104, but with the loop itself twisted through a long lead helix to cause the edges of the working elements to form a helix as seen at 105 and 106. The opening of the loop and thus the working elements are twisted substantially 180° to form the working elements into the helix shown. In this manner the working edges extend at a helix lead angle to the interior of the internal surface. The tool 100 shown in FIGS. 14 and 15 is formed of plain working element tapes which are not serrated or slit.

Figure 16:
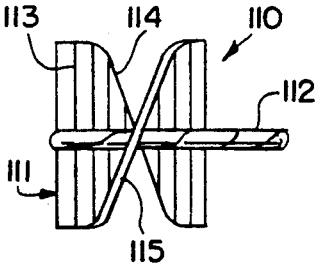
FIG. 16 is a view similar to FIG. 14 but showing the strip serrated or scored.
Figure 17:
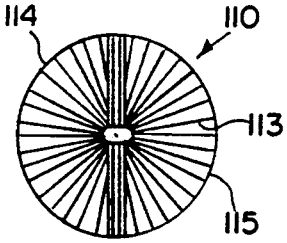
FIG. 17 is an axial end elevation of the tool of FIG. 16 as seen from the lefthand side thereof.

In FIGS. 16 and 17 there is illustrated a tool 110 which is similar to the tool 100 seen in FIGS. 14 and 15. The tool includes one or more working elements 111 secured in stem 112 in the same manner. Such working elements 111 are however slit or scored as indicated at 113 with such slits or scoring extending perpendicular to the working edges 114 and 115. If the working elements are slit they will be slit to approximately the stem and prior to assembly with and formation of the stem. If the working elements are simply scored they may be scored from one working edge to the other, again prior to insertion and formation of the stem. The scoring may be designed simply to enhance the flexibility of the working element or it may be designed to fracture during use of the tool. If the latter scoring or if slitting is employed, the tool provides in operation a plurality of rectangular fingers, the tips of each of which extend at a helix lead angle to the stem.

Figure 18:
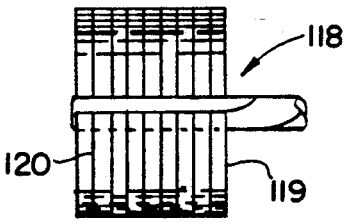
FIG. 18 is a view similar to FIG. 12 but showing the strip or strips serrated or scored.

FIG. 18 shows a tool 118 which is like that shown in FIG. 12 except that the working elements 119 are slit or scored as shown at 120 perpendicular to the tips or edges. Again the scoring or slitting is accomplished before the working elements are assembled to the stem 121 and shaped in the S configuration such as seen in FIG. 13.

Figure 19:
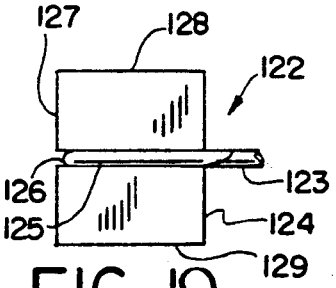
FIG. 19 is a side elevation of a twisted stem internal tool which has both side and a bottom working edges.

In FIG. 19 there is illustrated a tool 122 which is similar to the tool seen in FIGS. 10 and 11. Tool 122 includes a twisted stem 123 securing one or more working elements 124 by means of a loop 125 of the half round wires forming the stem. The loop 125 extends through a notch 126 in the edge 127 of the working elements. Accordingly, the edge 127 becomes a working edge in addition to the edges 128 and 129. The edges 128 and 129 will abrade the sides of an internal hole while the edge 127 abrades or spot faces the bottom of the hole.

Figure 21:
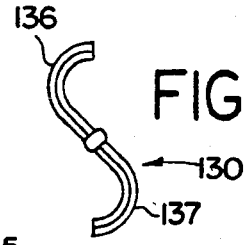
FIG. 21 is an axial end elevation of the tool of FIG. 20 as seen from the lefthand side thereof.
Figure 20:
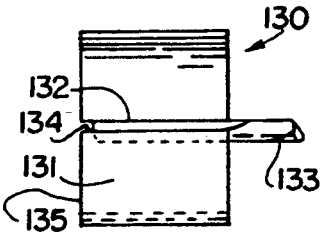
FIG. 20 is a side elevation of a tool similar to that of FIG. 19 but where the strap or straps are formed in an S-shape configuration.

In FIGS. 20 and 21 there is illustrated a tool 130 in which the working elements 131 are secured by loop 132 of the half round twisted stem 133, the end of the loop again fitting within notch 134 and being recessed from the edge 135. As seen in FIG. 21 the working elements are formed into the generally S-shape. The tool rotates counterclockwise as seen in FIG. 21 so that the flat sides of the working elements indicated at 136 and 137 bear against the interior side walls of a hole while the edge 135 abrades or spot faces the bottom of the hole.

Figure 22:
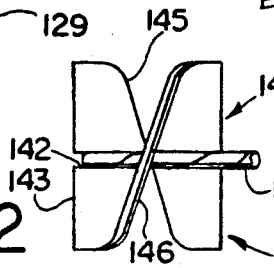
FIG. 22 is a side elevation of a tool similar to that of FIG. 19 but where the strip or strips are twisted into a helix.
Figure 23:
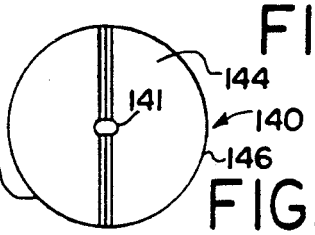
FIG. 23 is an axial end elevation of the tool of FIG. 22 as seen from the right hand end thereof.

In FIGS. 22 and 23 there is shown a tool 140 similar to the tool 100 seen in FIGS. 14 and 15. The half round wire twisted stem 141 is looped through a notch 142 in edge 143 of working elements 144. The loop is twisted in a long lead helix to form the working elements into the helix shown providing helical working edges 145 and 146. The helically disposed working edges 145 and 146 abrade the side wall of a hole or internal bore while the edge 143 abrades or spot faces the bottom of the hole. It will be appreciated that any one of the tool forms shown in FIGS. 19–23 may be scored or slit such as seen in FIGS. 16–18.

Figure 24:
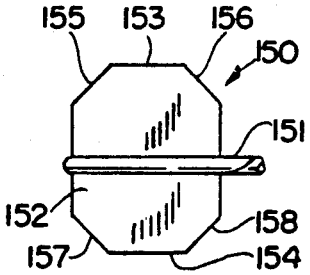
FIG. 24 is a side elevation of a tool similar to that of FIG. 19 but with chamfered working edges.

In FIG. 24 there is illustrated a tool 150 which is similar to that shown in FIG. 10 and has a twisted stem 151 looped about the center of working elements 152. Instead of the working elements being square or rectangular as in FIG. 10, the working edges 153 and 154 are chamfered so that the working edge 153 includes diagonal or chamfered working edges 155 and 156 symmetrically disposed on each side of the center thereof. Similarly, chamfered edges 157 and 158 are on opposite sides of the center working edge 154. The configuration of the working edges will depend upon the configuration of the workpiece being abraded or finished. The tool of FIG. 24 is excellent for undercut internal holes providing the proper abrading or honing required with a long lasting and aggressive tool.

Figure 25:
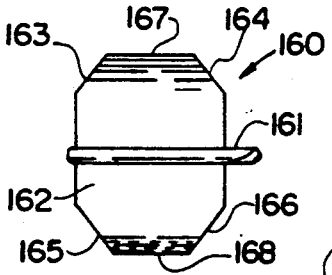
FIG. 25 is a side elevation of a tool similar to that of FIG. 24 but bent to an S-shape configuration as in FIG. 21.

The tool 160 of FIG. 25 also includes the half round wire twisted stem 161 securing the center of working elements 162 which are provided with the chamfered working edges 163, 164, 165 and 166. Instead of having working edges at the center, the working elements are shaped to the S-shape configuration seen in FIG. 21 for example, the top of the tool seen in FIG. 25 extending away from the viewer while the bottom extends towards the viewer. Then the center working surfaces become the flat sides of the working elements as seen at 167 and 168. The tool of FIG. 25 is useful for abrading or honing the same type of undercut workpieces as the tool of FIG. 24.

Figure 26:
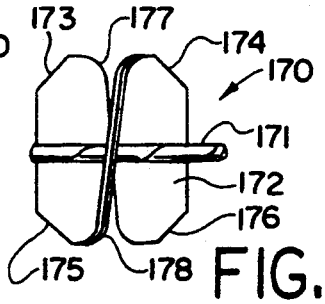
FIG. 26 is a side elevation of a tool similar to that of FIG. 24 but where the strip or strips are formed in a helical shape.
Figure 27:
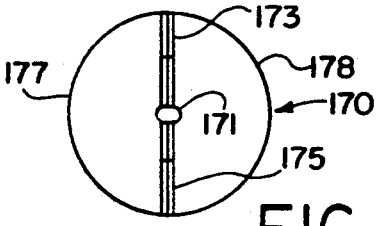
FIG. 27 is an axial end elevation of the tool of FIG. 26 as seen from the lefthand end thereof.

In FIGS. 26 and 27 there is illustrated a tool 170 also useful for abrading or honing internal undercut surfaces. Tool 170 comprises a twisted half round wire stem 171 which is looped around working elements 172. Again the corners of the working elements are chamfered as indicated at 173, 174, 175 and 176. However by means of the loop the working elements are twisted 180° to form the center interconnecting working edges 177 and 178 into the form of a helix.

While each of the tools seen in FIGS. 24–27 provide a very aggressive tool for abrading or honing undercut interior surfaces, it will be appreciated that each of the tools may be scored or slit in the manner above described to provide a greater degree of flexibility or rectangular fingers for the abrading operation.

Figure 28:
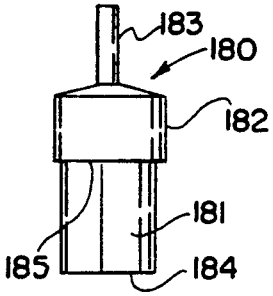
FIG. 28 is a side elevation of a tool wherein the strip is coiled and inserted in a rotary stem or holder to form a spot facing tool.
Figure 29:
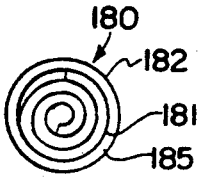
FIG. 29 is an axial elevation of the tool of FIG. 28 as seen from the bottom thereof.

In FIGS. 28 and 29 there is illustrated a tool 180 in which a strip or strap of abrasive-loaded nylon is heated and coiled into a tight coil as seen at 181 with one edge of the coil being adhesively secured to the bottom of a cup-shape shank 182. The shank is then rotated on the stem 183 to provide a spot facing tool with the edge of the coil indicated at 184 being the working face of the tool. Again the strip may be scored or slit perpendicular to such working edge 184 from the edge 185 of the cup-shape shank 182 to the working edge 184. Reference may be had to applicants' copending application entitled "Abrading And Finishing Tool And Method Of Making" filed Jan. 29, 1990, Ser. No. 07/471,383 for a more complete disclosure of such tool and its method of manufacture.

Figure 35:
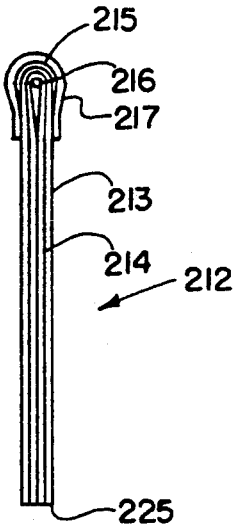
FIG. 35 is an enlarged end elevation of a strip section.
Figure 37:
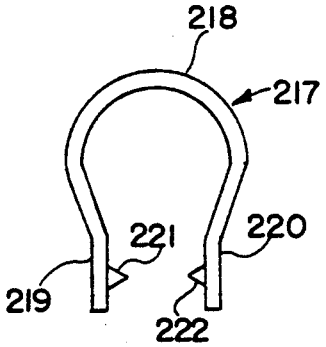
FIG. 37 is an enlarged end elevation of the strip forming channel or clasp.
Figure 36:
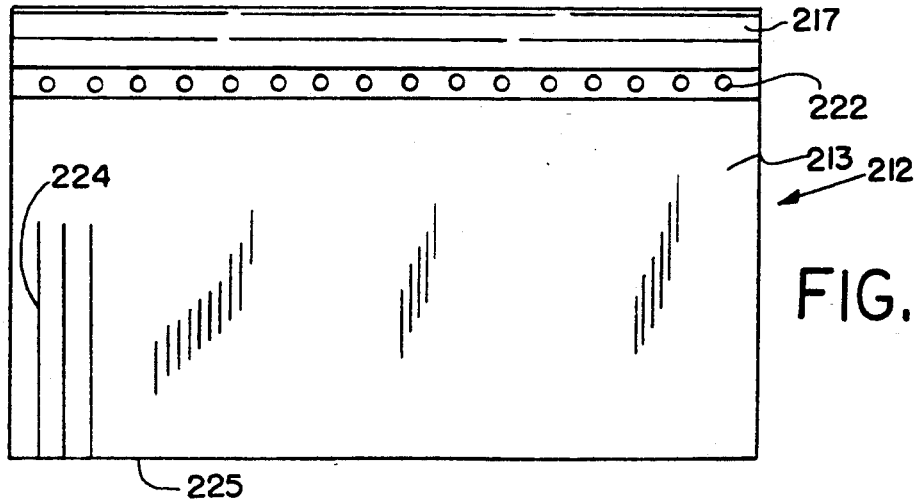
FIG. 36 is a side elevation of such strip section.

In FIGS. 30–34 there are illustrated two different types of tools which may be constructed utilizing tape strips, the construction and details of which are shown more clearly in FIGS. 35–37.

Figure 30:
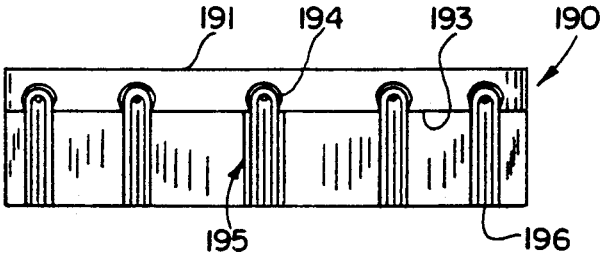
FIG. 30 is a side elevation of a disc tool formed of radially extending strips of folded tapes.
Figure 31:
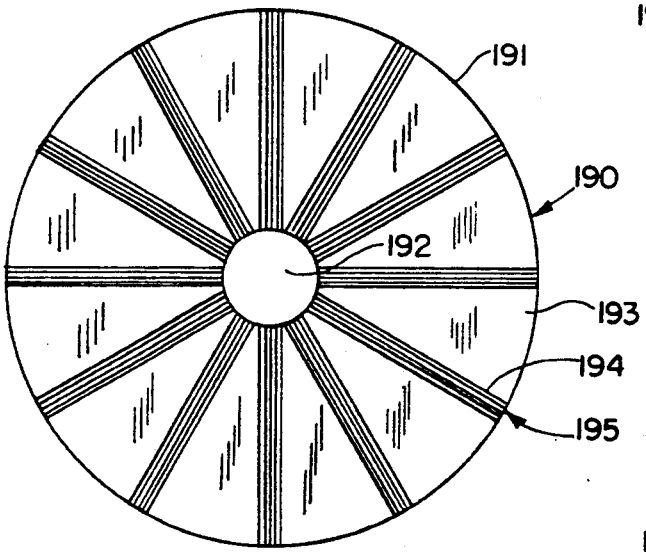
FIG. 31 is a bottom plan view of the tool of FIG. 30.

In FIGS. 30 and 31 there is illustrated a disc strip tool 190 which comprises a disc hub 191 having a central hole 192 through which the hub is mounted and driven for rotation about its axis. The underside 193 of the hub is provided with radially extending channels 194 which receive radially extending strips 195 which are made from one or more strap working elements in accordance with the present invention. The strips 195 are simply slipped into the channels 194 and locked in place. The working edges of each strip are indicated at 196 and are in the same plane. The tool of FIGS. 30 and 31 may be driven for rotation on a vertical or horizontal or other axis.

Figure 32:
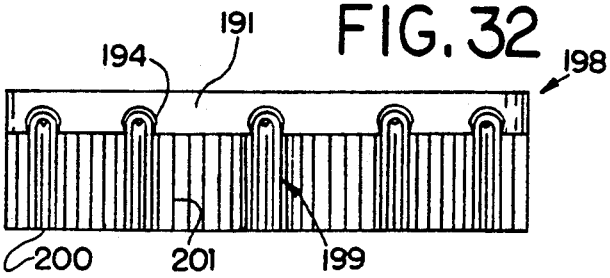
FIG. 32 is a view similar to FIG. 30 of a disc tool where the strips are serrated or scored.

FIG. 32 illustrates a disc strip tool 198 which employs radially extending tape strips 199 in which the straps are slit or serrated perpendicular to the working edge 200 as shown at 201. The flexibility of the tool at the working edge of the strip is controlled by the spacing of the slits or scoring and also by the depth of the slits or scoring from the working edge. The only difference between the tool shown in FIGS. 30 and 32 is that the strips of the tool of FIG. 32 are scored or slit.

Figure 33:
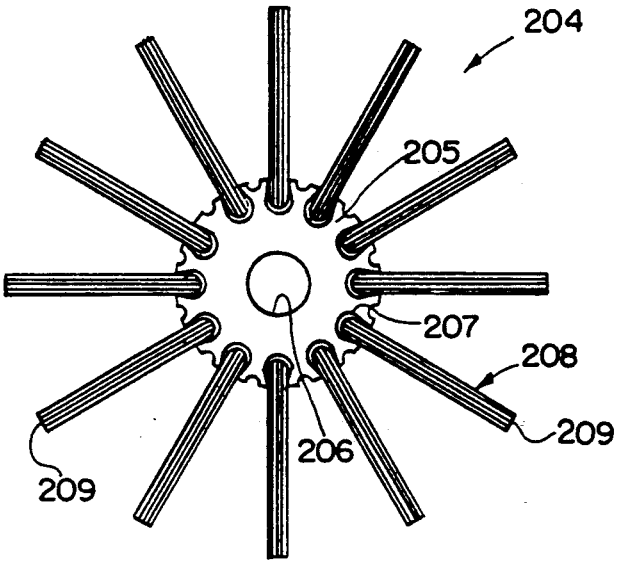
FIG. 33 is an axial end elevation of a radial strip cylindrical tool wherein the strips are secured to a hub.
Figure 34:
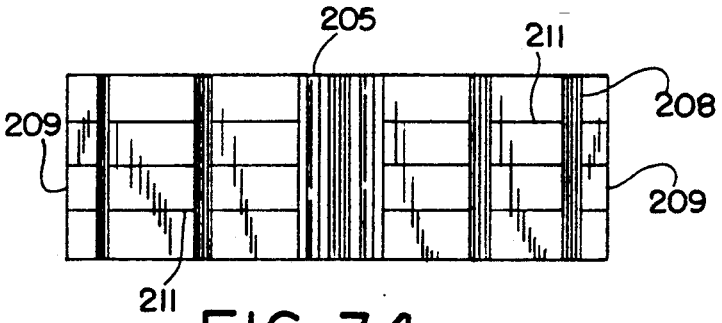
FIG. 34 is a side elevation of a tool such as shown in FIG. 33 and also showing the tapes of the strips serrated or scored.

In FIG. 33 there is shown a radial strip tool 204 which comprises a cylindrical hub 205 with a center hole 206 through which the hub is driven for rotation on its axis. The cylindrical exterior of the hub is provided with axially extending slots 207 in which are fitted tape strips 208. The working edges 209 of each working element of the strips 208 form a cylindrical working surface coaxial with the hub. The tool 204 of FIG. 33 may be rotated in either direction and forms a variation of the flap wheel such as seen in FIG. 9. The working elements of the strips 208 may be plain (unslit or unscored) or as indicated in FIG. 34 the strips may be slit or scored as seen at 211 perpendicular to the working edges. Again the flexibility of the working edges will depend upon the spacing of the parallel slit or score lines as well as the depth of such slit or score lines from the working edge.

FIGS. 35–37 illustrate the details of a working element strip which is indicated generally at 212 in FIGS. 35 and 36. As seen initially in FIG. 35 the strip is formed of two juxtaposed strips 213 and 214 which are folded at their longitudinal centers as indicated at 215 about an interior core wire or plastic monofilament 216 with the exterior of the fold being encased by a metal channel retainer 217.

The metal retainer or channel 217 includes a slightly enlarged bight portion 218 and the somewhat constricted legs 219 and 220 are provided with inwardly extending barbs or dimples 221 and 222, respectively, which may bite in to the outer working element.

As seen in FIG. 36, prior to the folding of the working elements at their longitudinal center, the strips may be transversely scored or slit as indicated at 224 perpendicular to their longitudinal edges 225 which become the working edges of the strip. To facilitate the bending or flat folding of the strips at their longitudinal center about the core 216 the strips may be locally heated at their centers. The metal retainer will be rolled or pressed in place during or after the folding operation. Such strip may be formed into continuous lengths and cut to fit a particular tool to which they are assembled either as original equipment or as a wear replacement part.

Like the flap wheels previously described, the tools of FIGS. 30–34 may be driven for rotation in either direction and because the abrasive material is homogeneously dispersed throughout the plastic and is exposed on all surfaces, the working elements of such tools are self-cleaning.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A working element for abrading tools comprising a strip consisting of a substantially rigid non-elastomeric synthetic plastic material, having a length, width and thickness and containing abrasive material embedded therein homogeneously throughout wherein said strip is scored.

2. A working element as set forth in claim 1 wherein said plastic material is nylon.

3. A working element as set forth in claim 1 wherein said strip contains about 30–45% by weight of granular abrasive material.

4. A working element as set forth in claim 1 wherein said strip has a width at least 5 times its thickness.

5. A working element as set forth in claim 1 wherein said strip has a width at least 10 times its thickness.

6. A working element as set forth in claim 1 wherein said plastic material is 6/12 nylon.

7. A working element as set forth in claim 1 wherein said plastic material is aramid.

8. A working element as set forth in claim 1 wherein said plastic material is polyester.

9. A working element as set forth in claim 1 wherein said plastic material is a polyimide.

10. A working element as set forth in claim 1 wherein said strip has a width to thickness ratio of about 30 to 1.

11. A working element as set forth in claim 1 wherein said strip has a thickness of about one millimeter.

12. A working element as set forth in claim 1 wherein said strip has a major parallel longitudinally and transversely extending faces defined by the length and width of the tape, respectively, said faces including said scoring.

13. A working element as set forth in claim 12 wherein said scoring extends longitudinally of said strip.

14. A working element as set forth in claim 12 wherein said scoring extends transversely of said strip.

15. A working element as set forth in claim 12 wherein said scoring extends partially longitudinally or transversely of said strip.

16. A working element as set forth in claim 12 wherein said scoring includes parallel score lines in said major faces.

17. A working element as set forth in claim 16 wherein said score lines in the respective faces are opposite each other whereby the thickness of the strip is substantially reduced between the opposite score lines.

18. A working element as set forth in claim 17 wherein said score lines enhance the flexibility of said strip and the closer said score lines are spaced, the greater the flexibility.

19. A working element as set forth in claim 16 wherein each score line is a rounded indentation.

20. A working element as set forth in claim 16 wherein each score line is a V-shape indentation.

21. A working element as set forth in claim 16 wherein each score line is shaped to promote controlled fracture of said strip along said score line when the tool in which said element is used is in operation.

22. A working element as set forth in claim 1 wherein said scoring forms partial slits in said strip is partially slit.

23. A working element as set forth in claim 22 wherein said strip includes parallel closely spaced slits.

24. A working element as set forth in claim 23 wherein said slits extend each to the same extent from one or both edges transversely of the strip.

25. A working element as set forth in claim 23 wherein said slits extend each to the same extent longitudinally of the strip.

26. An abrasive element for an abrasive tool comprising a strip of abrasive containing rigid non-elastomeric synthetic plastic having a length, width and thickness, folded longitudinally and clinched at the fold by a U-shape channel support so that the lateral edges of the strip are generally adjacent and parallel to each other.

27. A strip as set forth in claim 26 wherein said plastic is nylon.

28. A strip as set forth in claim 26 wherein said strip contains about 30–45% by weight of granular abrasive material.

29. A strip as set forth in claim 26 wherein said strip has a width at least 10 times its thickness.

30. A strip as set forth in claim 26 wherein said plastic material is selected from a group consisting of 6/12 nylon, aramids, polyesters, and polyimides.

31. A strip as set forth in claim 26 wherein each strip includes a plurality of folded and clinched tapes.

32. A strip as set forth in claim 26 wherein each tape is provided with slits extending transversely of the strip from each outer lateral edge.

33. A strip as set forth in claim 26 wherein each strip is provided with scoring extending transversely of the tape from each outer edge.

34. A strip as set forth in claim 33 wherein the configuration of the scoring promotes controlled fracture of the strip when the tool is in use.

35. A strip as set forth in claim 26 wherein said strip is folded longitudinally about an interior core plastic mono filament.

36. A working element for abrading tools comprising a substantially rigid non-elastomeric plastic strip having a length, width and thickness, and containing abrasive material embedded therein homogeneously throughout, and wherein said strip is heated and shaped or folded.

37. A working element as set forth in claim 36 wherein said strip includes score lines.

38. A working element as set forth in claim 37 wherein each score line is shaped to promote fracture of said strip along said score line when the tool in which said element is used is in operation.

39. A working element for abrading tools comprising a substantially rigid non-elastomeric plastic strip having a length, width and thickness, and containing abrasive material embedded therein homogeneously throughout, and wherein said strip is heated and shaped or folded, and, when cooled, substantially retains its shaped or folded condition.

* * * * *